United States Patent [19]

Southern

[11] Patent Number: 4,842,337

[45] Date of Patent: Jun. 27, 1989

[54] MINING BIT AND HOLDER

[76] Inventor: Philip W. Southern, 280 Ohio, Clarksburg, W. Va. 26301

[21] Appl. No.: 926,554

[22] Filed: Nov. 4, 1986

[51] Int. Cl.[4] ..... E21B 10/62; E21C 25/10

[52] U.S. Cl. ..... 299/80; 175/382; 299/81

[58] Field of Search ..... 299/79, 80, 81, 88, 299/91, 93; 175/382, 384, 393, 412, 410; 37/142 R

[56] References Cited

U.S. PATENT DOCUMENTS

| | | | |
|---|---|---|---|
| 2,650,071 | 8/1953 | Rassieur | 175/410 |
| 3,747,982 | 7/1973 | Agnew et al. | 299/81 |
| 3,751,114 | 8/1973 | Davis | 299/93 X |
| 3,774,324 | 11/1973 | Lafond | 37/142 R |
| 4,143,920 | 3/1979 | Haddock | 299/79 |
| 4,163,581 | 8/1979 | Krekeler | 299/91 |

FOREIGN PATENT DOCUMENTS

| | | | |
|---|---|---|---|
| 2817726 | 10/1979 | Fed. Rep. of Germany | 299/91 |
| 320615 | 1/1972 | U.S.S.R. | 299/91 |
| 1184794 | 3/1970 | United Kingdom | 299/79 |
| 2008170 | 5/1979 | United Kingdom | 299/91 |
| 1284539 | 8/1982 | United Kingdom | 299/91 |

*Primary Examiner*—Jerome W. Massie
*Assistant Examiner*—David J. Bagnell
*Attorney, Agent, or Firm*—Berman, Aisenberg & Platt

[57] ABSTRACT

A cutting apparatus includes a fixed holder and an orientable holder. The fixed holder is mounted to a cutting drum, and the orientable holder receives a cutting bit which may either be a forward attack bit or a conical bit. Orientation of the bit is accomplished by alignment of the orientable holder with respect to the fixed holder and by alignment of the bit with respect to the orientable holder. In a preferred embodiment, the fixed holder includes a block and liner, and the liner may assume either of two positions with respect to the block. The orientable holder includes passages and grooves for allowing a spray jet and hose to be received in the orientable holder to spray liquid on the cutting bit. The cutting surface of the bit includes two separate cutting tips, and the bit may be oriented to engage either tip with the material to be cut.

17 Claims, 5 Drawing Sheets

MINING BIT AND HOLDER

TECHNICAL FIELD

This invention relates to the art of mining bits and holders therefor.

BACKGROUND ART

In this art of mining, a plurality of cutting bits are attached to a rotating drum and advanced into a wall of rock to be mined. In a typical arrangement, the bit is held in a block which is mounted to the drum in a fixed position. Adjacent blocks are oriented with respect to each other so that each bit cuts a clearance for a succeeding bit. The bits are heated by frictional engagement with the rock, and dust is created by the cutting operation. Accordingly, it is known to provide a channel within the bit and supply that channel with a pressurized fluid, such as water, to cool the bit and reduce dust.

U.S. Pat. Nos. 3,397,012 (Krekeler) and 3,512,838 (Kniff) show mining tools wherein a conical bit having a cylindrical shank is held in a cylindrical opening in a holder. U.S. Pat. No. 4,193,638 (Heckenhauser) shows a multiple tip mining arrangement wherein a drum has a plurality of cutting bits mounted to an exterior surface. Each bit is held in a holder, and the shank of the bit is received in a tapered socket which is multi-sided to allow the bit to be indexed. U.S. Pat. Nos. 4,488,758 (Clemmow et al.) and 4,529,250 (Radford et al.) show a mining bit wherein a channel carries fluid through the bit to a spray opening. U.S. Pat. No. 4,453,775 (Clemmow) shows a cutting tool having a hardened cutting insert.

SUMMARY OF THE INVENTION

Prior art bits are not easily oriented because the blocks holding the bits are typically placed at a desired orientation with respect to the rotating drum and fixed in that orientation. This results in an inability to vary the orientation or to use different types of bits for which the pre-selected orientation is not correct.

Furthermore, a bit typically includes a channel through it for conducting the spray liquid. This results in an expensive bit which increases the cost of mining because a bit is typically a "throw-away" article.

In accordance with the invention, a unique apparatus is provided for holding a bit in any of a plurality selectable orientations. A block is secured to a rotating drum, and the block holds a bit-supporting element by engaging a shaft of the bit-supporting element. The shaft of the bit-supporting element may be oriented with respect to the block in any of several positions. The bit supporting element receives the bit also in any of several orientations. The bit-supporting element includes a head portion for receiving the bit such that the bit is orientable about an axis transverse to the longitudinal axis of the shaft of the bit-supporting element.

This allows the bit to be oriented in two transverse directions to permit the bit to be easily oriented, to receive a plurality of different bits, and to cut almost any desired clearance.

The inventive bit includes two hardened cutting tips which are separate from each other. Thus, if one of the tips breaks, the other is available for cutting. The bit is designed to be oriented to place either cutting tip in the proper orientation for cutting.

The bit-supporting element includes a channel for conducting spray liquid, and the spray outlet is in the bit-supporting element adjacent the bit. Thus, the bit need not be provided with a spray channel, and it is consequently less expensive to manufacture. In the preferred embodiment, a flexible tube is carried in a groove in the bit supporting element to reduce manufacturing costs.

It is an object of this invention to provide a unique holder for a mining bit.

Another object of this invention is to provide a mining bit having two hardened cutting elements (tips) and which is adapted to be received in any of several orientations in a supporting element.

A further object of this invention is to provide a combination of a bit-supporting element and a bit which allows the bit to be oriented easily into any of several orientations.

DETAILED DESCRIPTION OF THE INVENTION

Figure 1A:
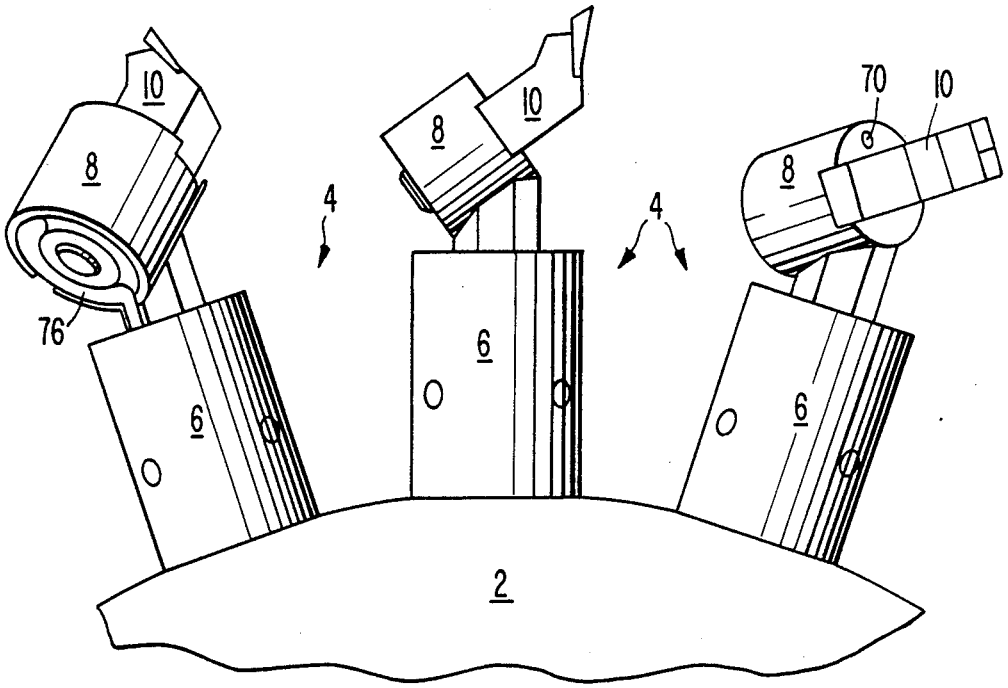
FIG. 1*a* is a partial side view of a rotating drum having three cutting elements in accordance with the invention thereon.
Figure 1B:
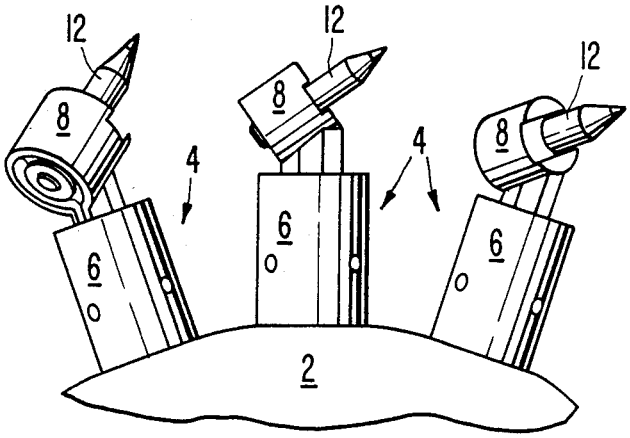
FIG. 1*b* is a side view similar to that of FIG. 1*a* with a second cutting bit thereon.

FIG. 1*a* is a side view of a portion of a cutting drum 2 having a plurality of cutting apparatus in accordance with the invention thereon. A cutting apparatus 4 generally comprises a fixed holder 6 which is securely mounted to cutting drum 2, orientable holder 8 which is held by fixed holder 6 and a bit 10. FIG. 1b shows a similar arrangement, except that bits 12 are conical bits instead of forward-attack bits 10 illustrated in FIG. 1a. It is a feature of this invention that the orientable holder 8 is capable of receiving either a forward attack bit or a conical bit.

Figure 2:
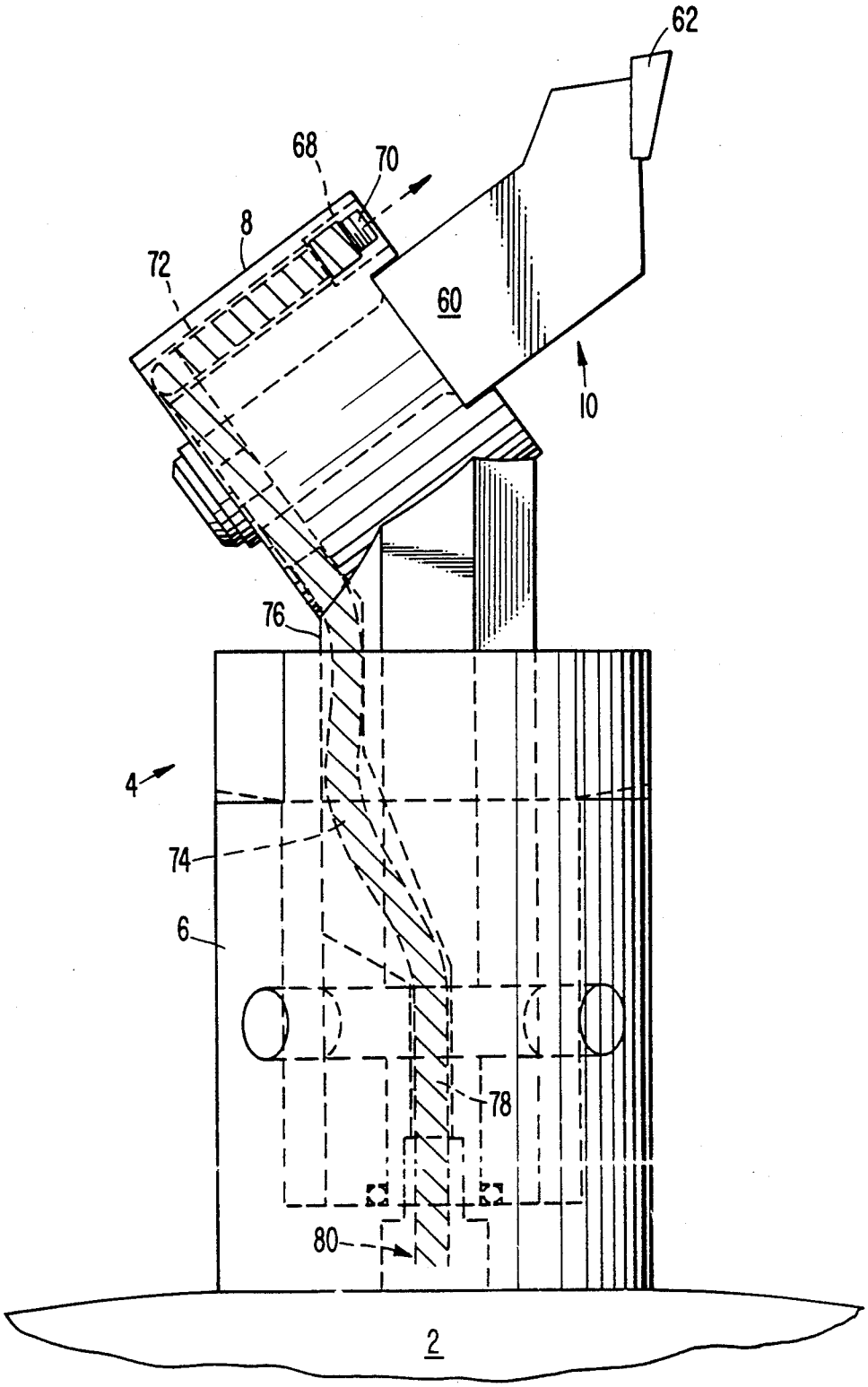
FIG. 2 is a side view in partial cross-section showing a bit, block and bit-supporting element in accordance with the invention.
Figure 3:
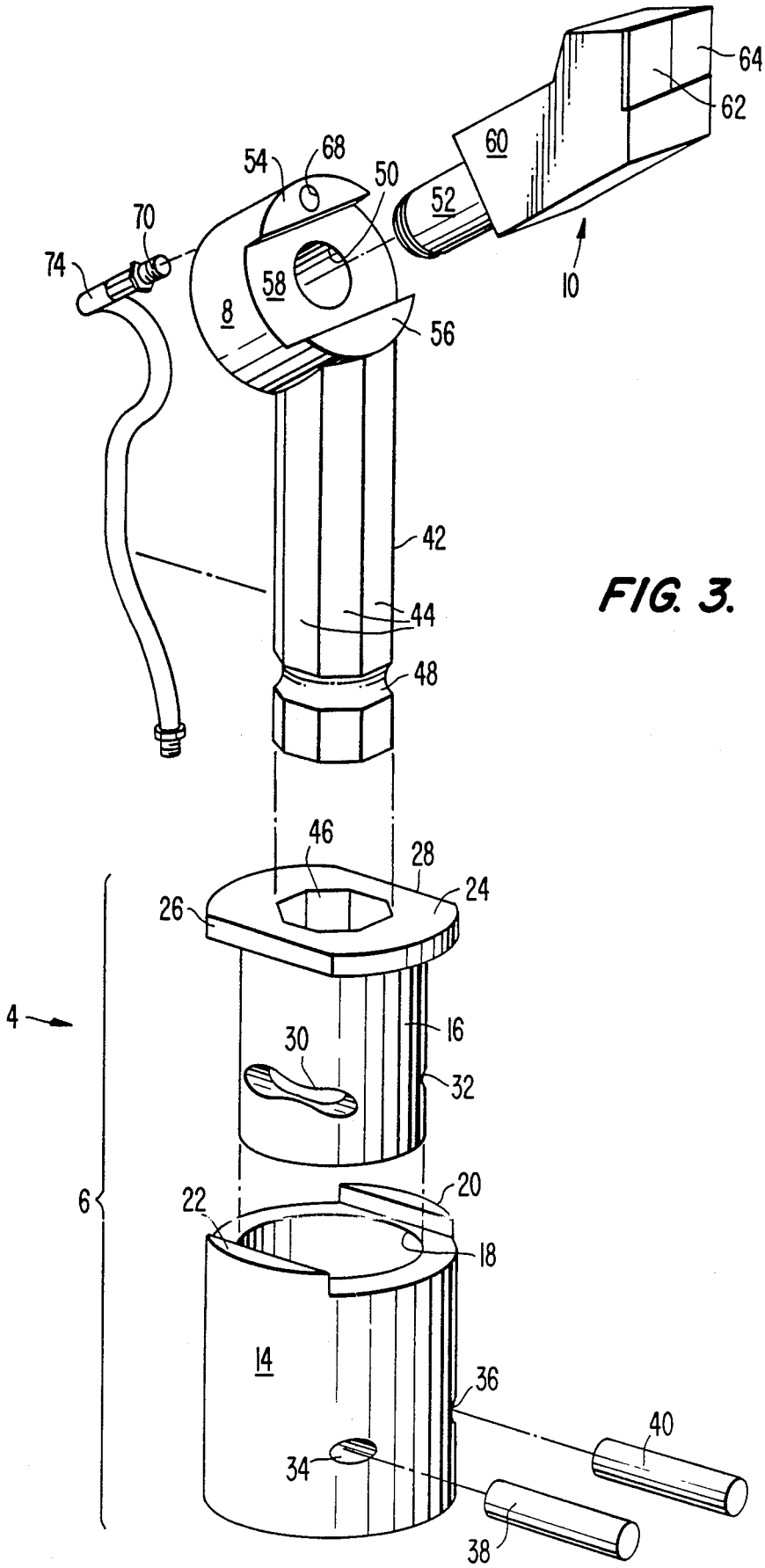
FIG. 3 is an exploded view of the apparatus shown in FIG. 2.

FIG. 2 is a side view of a cutting apparatus 4 in accordance with the invention, and FIG. 3 is an exploded diagram of the apparatus shown in FIG. 2. With reference to FIGS. 2 and 3, a first embodiment of the fixed holder 6 comprises a block 14 and a linear 16. Block 14 has a cylindrical opening 18 therein and flanges 20 and 22 extend beyond the upper edge of opening 18 on opposite sides thereof. Liner 16 is cylindrical and includes an upper flange 24. Upper flange 24 includes side surfaces 26 and 28 which engage flanges 20 and 22 of block 14 when liner 16 is received in cylindrical opening 18. Slots 30, 32, align with openings 34, 36 when liner 16 is received in cylindrical opening 18, and pins 38, 40 may be inserted to retain liner 16 securely in cylindrical opening 18.

It will be appreciated that liner 16 is symmetrical about the cylindrical axis of opening 18 so that it may be received in block 14 in either of two orientations. This extends the lifetime of liner 16 by allowing it to be rotated to distribute wear. Additionally, it will be appreciated that liner 16 is easily replaced when worn by simply removing pins 38 and 40 and replacing the liner.

Holder 8 includes a shank 42 having a plurality of planar faces 44 thereon. In the preferred embodiment, shank 42 is octagonal in transverse cross-section. Liner 16 includes an opening 46 which matches the shape of shank 42 such that shank 42 may be received in opening 46 when the cutting apparatus is assembled. Shank 42 includes a groove 48 which aligns with slots 30 and 32 and is engaged by pins 38 and 40 when the apparatus is assembled.

It will be appreciated that orientable holder 8 may be placed in any of several orientations by aligning shank 42 within opening 46 in the desired orientation. This allows the field holders 6 to be secured to the cutting drum 2 in a single orientation while still permitting bits 10 (or 12) to be oriented in a plurality of directions by rotating holder 8 with respect to fixed holder 6.

Bit 10 is received in a head portion of holder 8. A cylindrical opening 50 receives a cylindrical shank 52. Flanges 54 and 56 extend upwardly from a planar surface 58 to form a slot which is engaged by a base portion 60 of bit 10. In the preferred embodiment, base portion 60 is rectangular in transverse cross-section so that bit 10 may be placed in any of four orientations. Shank 52 is held in opening 50 in any known manner, for example by a snap-ring.

Figure 4:
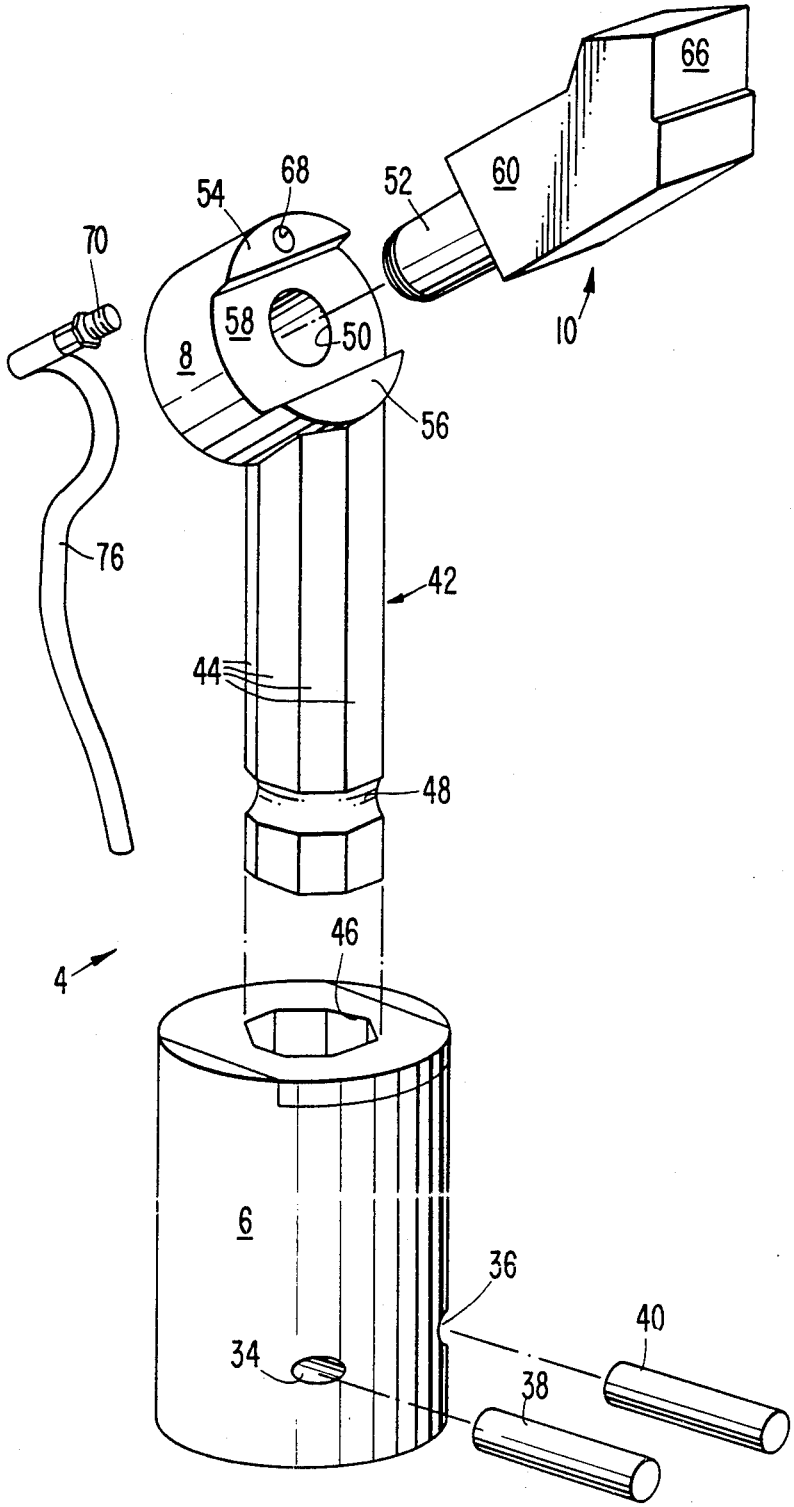
FIG. 4, is an exploded diagram of a second embodiment in accordance with the invention.

The cutting end of bit 10 preferably includes two cutting tips 62 and 64 which are secured to bit 10 by a known adhesive and received on a face 66 (see FIG. 4). This arrangement is advantageous because if a tip engaging rock being cut breaks the other cutting tip will be unaffected because it is separate therefrom. The bit 10 may continue to be used by simply rotating the bit with respect to holder 8 to engage the unbroken cutting tip with the rock being cut.

As is known in the art, mining creates a substantial amount of heat because of the frictional engagement of the bit with the rock being cut, and a substantial amount of dust is produced. Accordingly, it is desirable to provide a spray of liquid on the area of engagement between the cutting bit and the rock. In accordance with the invention, orientable holder 8 includes an opening 68 for receiving a spray jet 70, an elongate opening 72 for receiving a portion of a hose 74, groove 76 (see FIG. 5), and second opening 78 also for receiving hose 74. As seen in FIG. 2, hose 74 terminates at end 80 which communicates with the interior of cutting drum 2 to allow pressurized fluid to flow from cutting drum 2 through hose 74 and to spray out of jet 70 onto the region of contact between bit 10 and a rock being cut.

In accordance with the spray feature of the invention, it is not necessary to provide an opening in bit 10 as in the prior art, and this substantially reduces the cost of bit 10 which is typically a throw-away particle. Furthermore, because jet 70 is secured in holder 8, orientation of the spray will automatically be proper.

FIG. 4 shows a second embodiment of a cutting apparatus 4, and features having the same properties of FIG. 3 have been identified with the same reference numerals. In the embodiment of FIG. 4, fixed holder 6 comprises a single element having an opening 46 therein for receiving shank 42 of orientable holder 8. Thus, liner 16 and block 14 of FIG. 3 have been made integral in the embodiment of FIG. 4.

Figure 5:
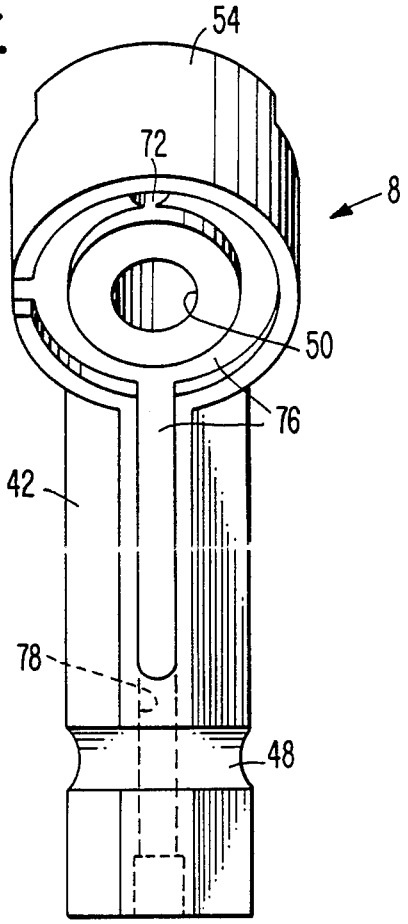
FIG. 5, is a front view of a bit supporting element in accordance with the invention.
Figure 6:
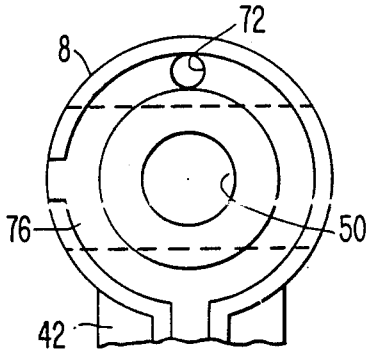
FIG. 6 is an end view of the head portion of the bit supporting element shown in FIG. 5.

FIG. 5 is a rear elevation of the bit holder 8, and FIG. 6 is an elevation view of the rear surface of the head of the bit holder 8.

It will be appreciated that a unique cutting apparatus has been described. Orientation of a cutting bit is easily accomplished by orientation of holder 8 with respect to holder 6 and orientation of bit 10 with respect to holder 8. As shown in FIG. 1*a* a plurality of cutting apparatus may be easily arranged on a cutting drum with the cutting bits oriented to cut the proper clearance. Orientable holder 8 operates with a conical bit equally well as shown in FIG. 1*b*, it being necessary only to provide a conical bit 12 having a shank of a shape identical to that of shank 52 of the forward-attack bit 10.

Modifications within the scope of the appended claims will be apparent to those who are skilled in the art.

What is claimed is

1. A mining apparatus comprising orientable holder means for holding a cutting bit, said orientable holder means comprising a shank having at least two sets of parallel faces thereon, fixed holder means having an opening for receiving said shank, said opening having faces for engaging said parallel faces of said shank for securing said orientable holder means in any of at least four orientations, and a cutting bit held by said orientable holder means, whereby said orientable holder means may be placed in a predetermined orientation of a plurality of possible orientations with respect to said holder means.

2. Apparatus according to claim 1 wherein said shaft and said opening are octagonal in transverse cross-section.

3. Apparatus according to claim 2 wherein said cutting bit comprises a base having four rectangular faces and said support orientable holder means comprises a slot for receiving said base in at least two orientations.

4. Apparatus according to claim 3 wherein said fixed holder means comprises block means and liner means, said block means comprising means for engaging said liner means in at least two angular orientations about a longitudinal axis of said block means and said liner means engages said orientable holder means.

5. Apparatus according to claim 1 wherein said cutting bit comprises a polyhedral base and said orientable holder means comprises a slot for receiving said base.

6. Apparatus according to claim 1 wherein said fixed holder means comprises block means and liner means, said block means comprising means for engaging said liner means in at least two angular orientations about a longitudinal axis of said block means and said liner means engages said orientable holder.

7. A mining apparatus according to claim 1 wherein said orientable holder means has a conduit means therein for conducting a fluid under pressure to a location for spraying said fluid onto a cutting area.

8. Apparatus according to claim 7 wherein said conduit means comprises a flexible tube carried in a groove in said orientable holder means.

9. Apparatus according to claim 7 wherein said conduit means comprises a tube having a spray nozzle at one end thereof.

10. Apparatus according to claim 9 wherein said shank has a groove for receiving said tube and said orientable holder has an opening for receiving said tube.

11. Apparatus according to claim 10 wherein said shank is formed by a plurality of rectangular faces each of which is parallel to a central axis of said shank.

12. Apparatus according to claim 11 wherein said orientable holder provides a slot for receiving said cutting bit.

13. A mining apparatus comprising fixed holder means for attachment to a cutting drum, orientable holder means for being received by said fixed holder means, said fixed holder means and said orientable holder means having means for allowing said orientable holder means to be adjusted angularly with respect to said fixed holder means about a first axis by an angular extent of about ninety degrees or less, and bit means for cutting material, said bit means and said orientable holder means having means for allowing said bit means to be received in said orientable holder means for angular adjustment about a second axis, wherein said second axis is transverse to said first axis.

14. A mining apparatus according to claim 13 wherein said fixed holder means comprises a first element for attachment to a cutting drum and liner means received by said first element, said liner means having means for receiving said orientable holder.

15. A mining apparatus according to claim 14 wherein said liner means is obtainable with respect to said first element.

16. A mining apparatus according to claim 13 wherein said bit means comprises a shank for being received in said orientable holder, a base for engaging flanges on said orientable holder, and a face for receiving cutting tip means.

17. A mining apparatus according to claim 16 wherein said face is displaced from a longitudinal axis of said shank.

* * * * *